US005684520A

United States Patent [19]

Morikoshi et al.

[11] Patent Number: 5,684,520

[45] Date of Patent: Nov. 4, 1997

[54] INK JET RECORDING HEAD IN WHICH AN ACTUATOR IS OFFSET FROM A CENTER OF AN EFFECTIVE DISPLACEMENT REGION OF A VIBRATION PLATE

[75] Inventors: Koji Morikoshi; Yuji Tanaka; Shuji Yonekubo; Norihiko Kurashima, all of Nagano, Japan

[73] Assignee: Seiko Epson Corporation, Tokyo, Japan

[21] Appl. No.: 770,063

[22] Filed: Dec. 19, 1996

Related U.S. Application Data

[63] Continuation of Ser. No. 421,450, Apr. 13, 1995, abandoned.

[30] Foreign Application Priority Data

Apr. 13, 1994 [JP] Japan ..... 6-075097
Apr. 10, 1995 [JP] Japan ..... 7-109069

[51] Int. Cl.[6] ..... B41J 2/045

[52] U.S. Cl. ..... 347/70; 347/68

[58] Field of Search ..... 347/68–72

[56] References Cited

U.S. PATENT DOCUMENTS 4,418,355 11/1983 DeYoung et al. ..... 347/70
5,424,769 6/1995 Sakai et al. ..... 347/70

FOREIGN PATENT DOCUMENTS

A 0 443 628 A2 8/1991 European Pat. Off. ..... 347/70
A 0 575 983 A2 12/1993 European Pat. Off. ..... 347/70

*Primary Examiner*—Benjamin R. Fuller
*Assistant Examiner*—Charlene Dickens
*Attorney, Agent, or Firm*—Sughrue, Mion, Zinn, Macpeak & Seas

[57] ABSTRACT

A piezoelectric vibration element is abutted against a vibration plate such that a central point C1 of the piezoelectric vibration element by is displaced by a distance Δd toward a nozzle opening from a central point C2 of a length L of an effective displacement region on vibration plate, whereby the displacement of the piezoelectric vibration during operation of the element is particularly efficiently transmitted to ink in the vicinity of the nozzle opening.

6 Claims, 7 Drawing Sheets

INK JET RECORDING HEAD IN WHICH AN ACTUATOR IS OFFSET FROM A CENTER OF AN EFFECTIVE DISPLACEMENT REGION OF A VIBRATION PLATE

This is a Continuation of application Ser. No. 08/421,450, filed Apr. 13, 1995 now abandoned.

BACKGROUND OF THE INVENTION

1. Field of the Invention

The invention relates to an ink jet recording head using piezoelectric vibration elements of vertical vibration mode as an actuator.

2. Related Art

Ink jet recording heads using piezoelectric vibration elements as an actuator come in two types: one utilizing displacement of the piezoelectric vibration element in a transverse direction and one utilizing displacement thereof in the axial, or longitudinal direction.

The former type is advantageous not only in deforming a relatively large area but also in reducing the cost of manufacture, since the ink jet recording head can be formed integrally with a flow path forming plate by sintering, the flow path forming plate including pressure producing chambers and the like. On the other hand, the distance between the nozzle openings must be increased as a result of the transverse mode of operation, which imposes the problem of making a high-density head hard to produce.

In contrast thereto, the latter type is characterized as making the piezoelectric vibration element highly rigid. Accordingly, it is possible to jet ink droplets by merely abutting an end of the piezoelectric vibration element against the vibration plate that seals one surface of the pressure producing chamber. This in turn contributes to achieving a high-density nozzle opening arrangement. However, since it is only a limited portion of the vibration plate that is deformed, a rigid portion must be provided in the vibration plate extending along the axial direction of the pressure producing chamber so that the displacement of the piezoelectric element can be transmitted effectively. This can be achieved by arranging a so-called island portion in the vibration plate.

The island portion is designed to extend along the length of the pressure producing chamber so as to be symmetrical with respect to the central point of the pressure producing chamber. The piezoelectric vibration element of the vertical vibration mode abuts against the vibration plate in such a manner that the axis of the piezoelectric vibration element is aligned with a central point of the island portion, i.e., the center of the pressure producing chamber.

In the recording head utilizing a piezoelectric vibration element of the vertical vibration mode, the rigidity of the piezoelectric vibration element itself is large, and the area of abutment of the piezoelectric vibration element against the island portion is as small as about 0.03 mm×0.03 mm. On the other hand, the length of the island portion in the axial direction of the pressure producing chamber is as large as about 0.7 mm and the thickness and width thereof are as small as about 0.2 to 0.3 mm. Therefore, at the ink droplet jetting time, at which a large load is applied to the island portion, the following phenomenon occurs, namely the more remote a region of the island portion is from the piezoelectric vibration element, the more such region of the island portion flexes, due to the elasticity thereof. Under such condition, if the fluid impedance of the ink supply inlet is in equilibrium with that of the nozzle opening, then pressure within the pressure producing chamber acts sufficiently on a region close to the nozzle opening, thereby allowing ink necessary for printing to be jetted out.

However, recently developed recording heads are designed to increase printing speed by increasing the recording head driving frequency. However, this gives rise to the problem that the response of the ink is slow compared with that of the piezoelectric vibration element. In the new recording heads, therefore, the flow speed of the ink in the pressure producing chamber, is increased or the quantity of movement of the meniscus is decreased by decreasing the fluid impedance of the ink supply inlet compared with that of the nozzle opening. In such an ink recording heads, the quantity of the ink returning to the common ink chamber from the pressure producing chamber is increased on one hand, and the quantity of an ink droplet jetted out of the nozzle opening is decreased on the other at the time the pressure producing chamber is in contraction, thereby imposing the problem of impairing printing quality.

It is conceivable to increase the rigidity of the island portion or increase the displacement of the piezoelectric vibration element in order to overcome this problem. However, these techniques lead to other problems such as that the head becomes large in its overall structure and that a large stress is applied locally to the thin wall portion, causing the vibration plate, etc. to break.

SUMMARY OF THE INVENTION

The invention has been made in view of the aforementioned problems. Therefore, the object of the invention is to provide a novel ink jet recording head that can efficiently utilize the displacement of the piezoelectric vibration element to jet an ink droplet without applying large stress locally to the vibration plate.

To achieve the above object, the invention is applied to an ink jet recording head including a flow path unit and a piezoelectric vibration element of vertical vibration mode. The flow path unit includes a spacer, a nozzle plate, and a vibration plate, the spacer defining a pressure producing chamber, an ink supply inlet, and a common ink chamber, the nozzle plate sealing a single surface of the spacer and having a nozzle opening communicating with an end of the pressure producing chamber, and the vibration plate sealing the other surface of the spacer and expanding and contracting the pressure producing chamber. The tip of the piezoelectric vibration element is abutted against the vibration plate, to displace the vibration plate. In such ink jet recording head, the piezoelectric vibration element is caused to be abutted against the vibration plate by displacing a center of the piezoelectric vibration element toward the nozzle opening by a distance $\Delta d$ from a central point of an effective displacement region of the vibration plate.

The quantity of ink jetted with respect to a displacement of the piezoelectric vibration element is increased by efficiently compressing the ink in the pressure producing chamber in the vicinity of the nozzle opening while transmitting the displacement of the piezoelectric vibration element for compressing the pressure producing chamber to a region in the vicinity of the nozzle opening as much as possible.

DETAILED DESCRIPTION OF THE PREFERRED EMBODIMENTS

Figure 1:
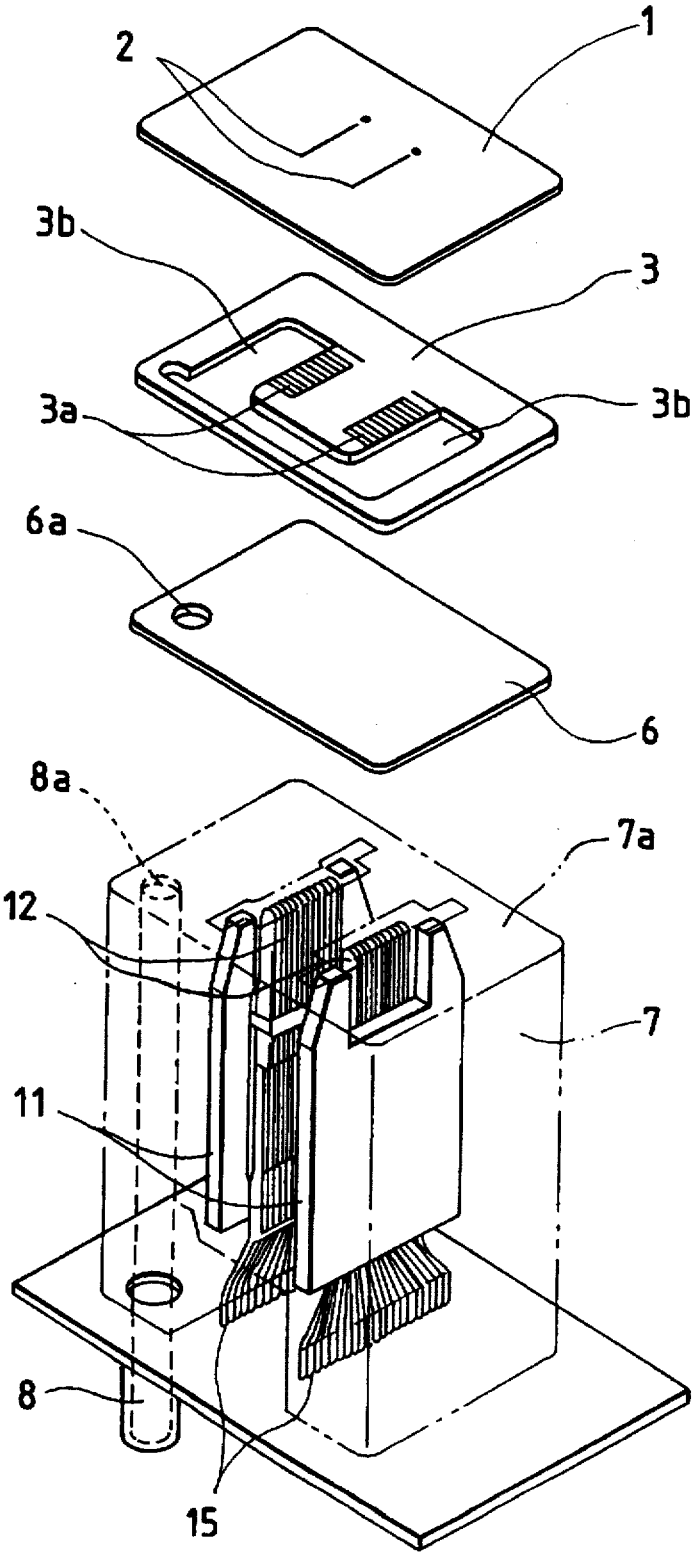
FIG. 1 is an exploded perspective view showing an embodiment of the invention.

The invention will now be described in detail with reference to embodiments shown in the drawings.

FIG. 1 shows an embodiment of the invention. In FIG. 1, reference numeral 1 denotes a nozzle plate having two arrays of nozzle openings 2; and 3 designates, a spacer having cavities 3*a*, 3*a*, 3*a* . . . and windows 3*b*, 3*b*. The cavities 3*a* define pressure producing chambers 4 and windows 3*b* form a common ink chamber 5. One end of each cavity 3*a* is located at a position corresponding to the nozzle opening 2 and the other end thereof communicates with the common ink chamber 5.

Reference numeral 6 denotes a vibration plate, which has a through hole 6*a*. The through hole 6*a* is provided to supply ink to the common ink chamber 5 while connected to an opening 8*a* of an ink supply tube 8 arranged in a frame 7.

Figure 3:
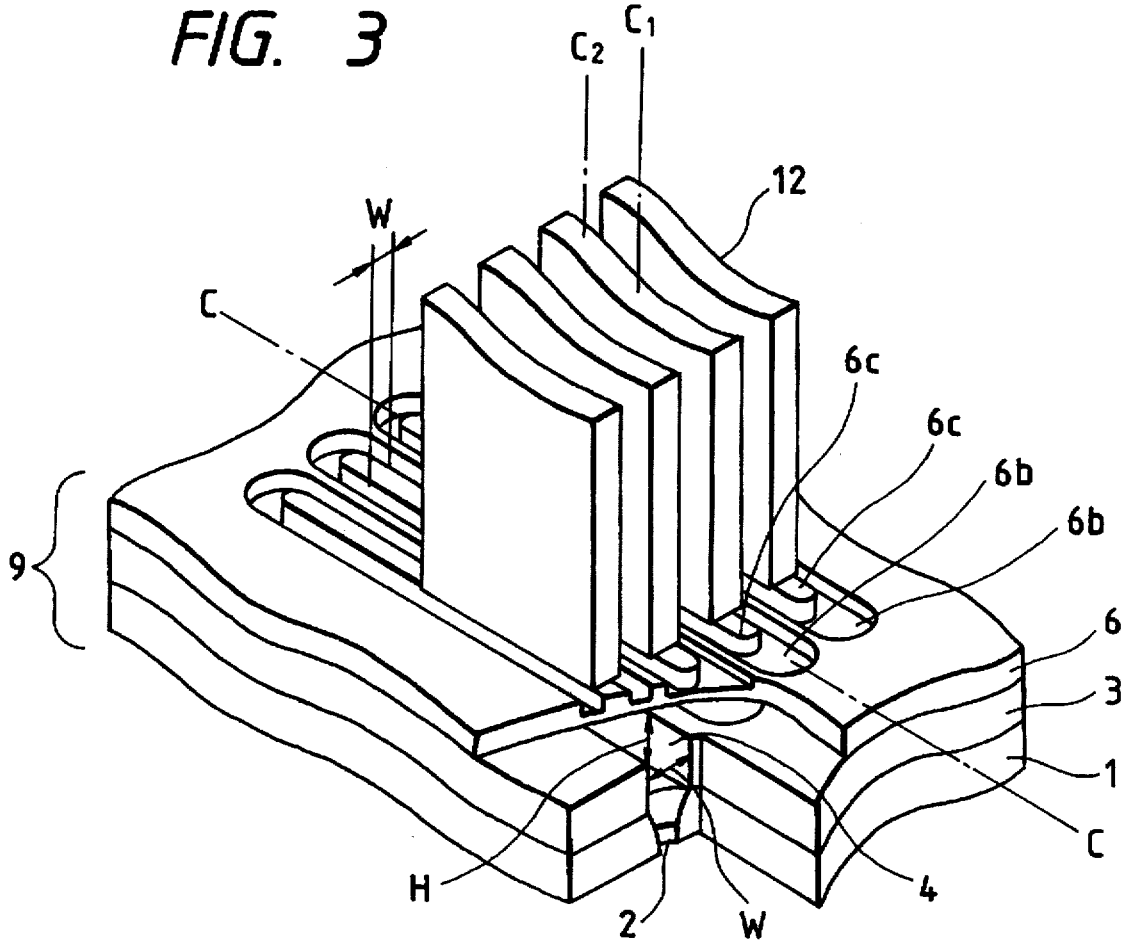
FIG. 3 is an enlarged perspective view showing a surface of abutment between piezoelectric vibration elements and a vibration plate an the embodiment of the invention.

As more readily apparent from FIG. 3, the vibration plate 6 has thin wall portions 6*b* and island portions 6*c* on a surface (the lower surface as viewed in FIG. 1) confronting piezoelectric vibration elements 12. The thin wall portion 6*b* is displaced by the expansion and contraction of the piezoelectric vibration element 12. The island portion 6*c*, which is a thick wall portion having such a rigidity as to transmit the displacement of the piezoelectric vibration element 12 in the axial direction of the pressure producing chamber 4, extends along the center line C of the pressure producing chamber 4.

The nozzle plate 1, the spacer 3, and the vibration plate 6 are bonded together to form a flow path unit 9, and are fixed to a surface 7*a* of the frame 7 so that the respective island portions 6*c*, 6*c*, 6*c* . . . are in contact with the corresponding ends of the piezoelectric vibration elements 12, 12, 12 . . . of the piezoelectric vibration element unit 11, 11 accommodated in the frame 7.

Figure 2:
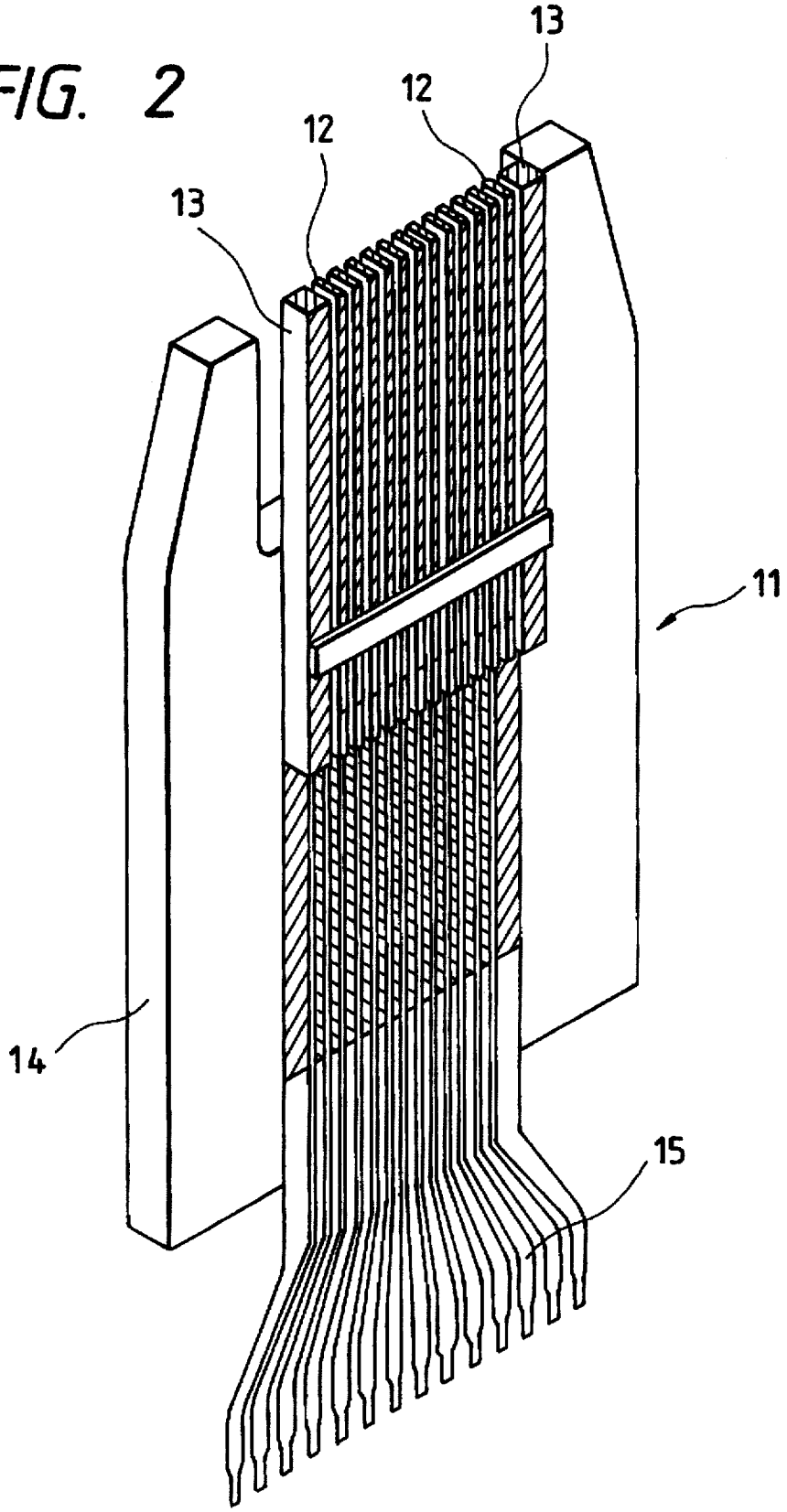
FIG. 2 is a perspective view showing an exemplary piezoelectric vibration element unit of vertical vibration mode which can be applied to the invention.
Figure 4:
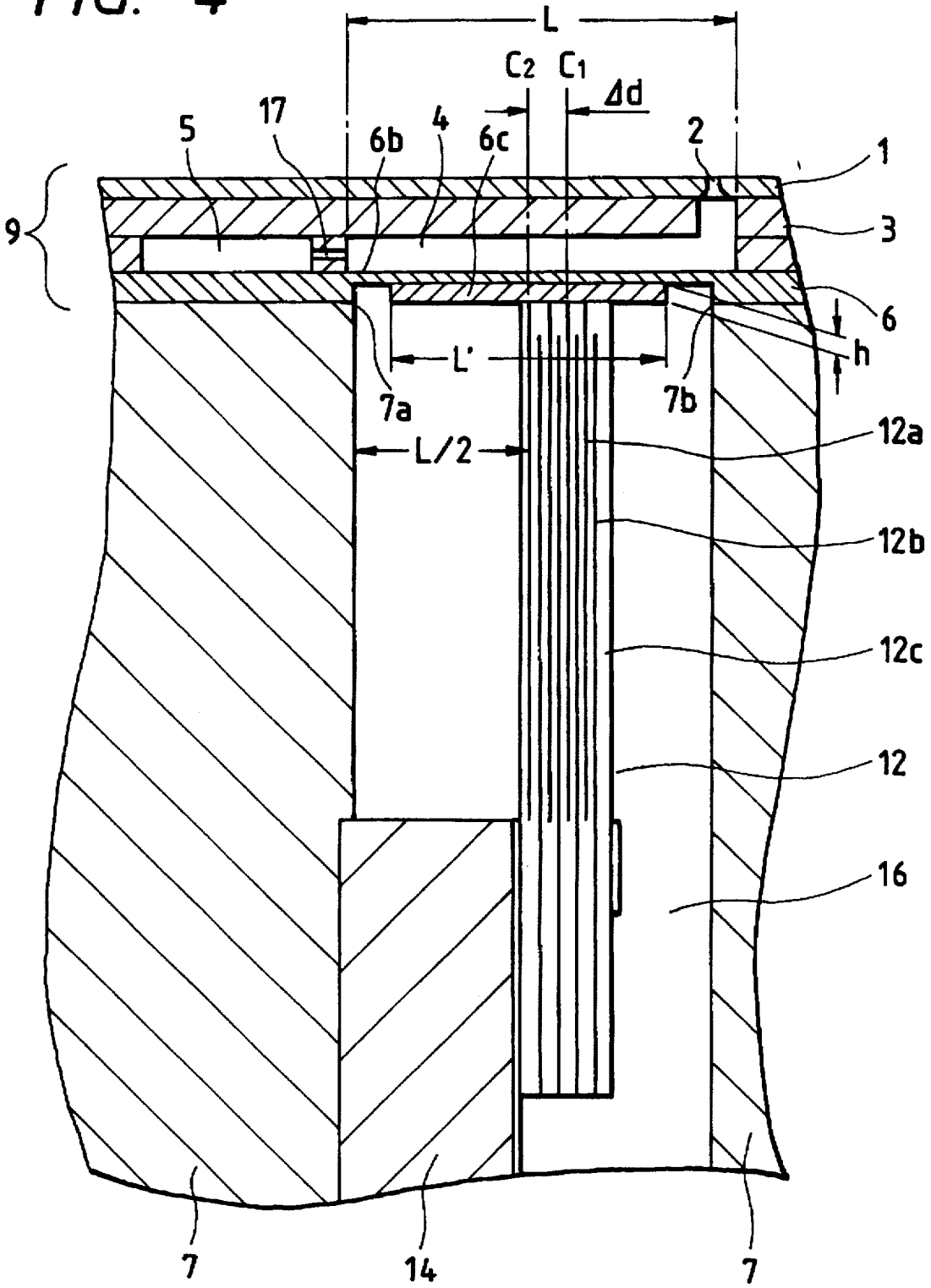
FIG. 4 is a sectional view of the embodiment of FIG. 3 according to the invention.

FIG. 2 shows an example of the aforementioned piezoelectric vibration element unit 11. In FIG. 2, reference numeral 12, 12, 12 . . . denotes piezoelectric vibration elements. Each piezoelectric vibration element is arranged by tooth shaping a piezoelectric vibration plate at a predetermined interval with positioning dummy vibration elements 13, 13 retained left at the outermost ends. The piezoelectric vibration plate is prepared by sintering while laminating a layer of a piezoelectric material such as PZT in paste form and an electrically conducting paste layer one upon another alternately so that the piezoelectric layer 12*c* is interposed between an electrode 12*a* on one hand and en electrode 12*b* on the other (as best illustrated in FIG. 4). The thus constructed piezoelectric vibration elements 12 are assembled into a unit by fixing a half part thereof (the lower half as viewed in FIG. 2) to a fixing plate 14 made of metal or ceramic with an adhesive.

Each vibration element 12 has electrodes formed on a surface thereof and has one end of an electrode connected to a leadframe 15, so that the tip of the element 12 expands and contracts in response to a print signal.

FIGS. 3 and 4 show in enlarged form, a surface along which the piezoelectric vibration elements 12, 12, 12 . . . are abutted against the vibration plate 6. The vibration plate 6 is supported by faces 7*a*, 7*b* of a piezoelectric vibration element accommodating chamber 16 of the frame 7 in the longitudinal direction thereof, and is fixed so as to vibrate with these faces as joints. The length of an effective displacement region, i.e., the span of vibration, is set to L.

The piezoelectric vibration element 12 has an end thereof fixed to the corresponding surface of the island portion 6*c* with an adhesive or the like so that a central point C1 thereof is displaced toward the nozzle opening a distance $\Delta d$ from a position C2 that is a position a half the effective displacement region L of the vibration plate 6 (the central point of the pressure producing chamber 4 in this example).

Figure 5A:
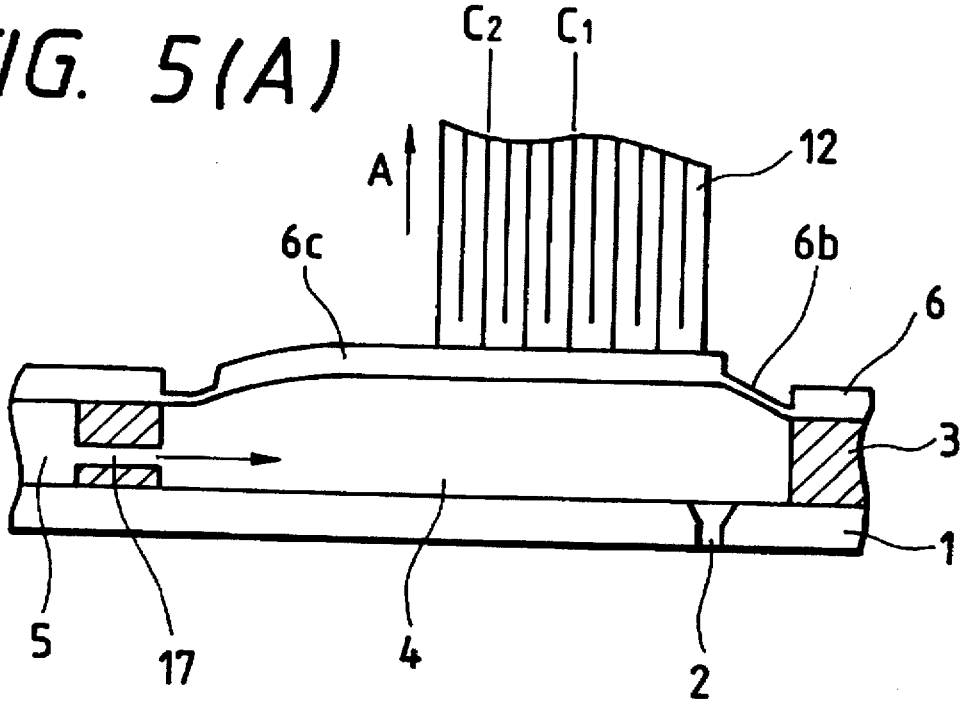
FIGS. 5 (A) and (B) are diagrams for illustrating the operation of a recording head embodying the invention.
Figure 5B:
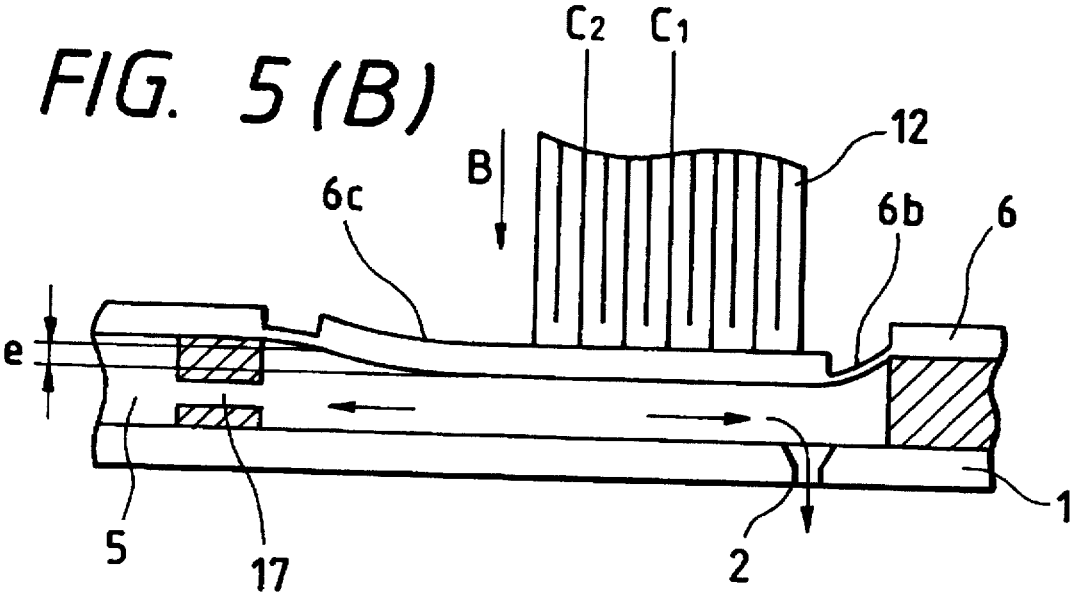

In this example, when the piezoelectric vibration element 12 contracts as shown by the arrow A in FIG. 5 (A), the effective displacement region of the vibration plate 6 is raised as viewed in FIG. 5 (A) through the island portion 6*c* to which the tip of the piezoelectric vibration element is fixed, which elastically deforms the thin wall portion 6*b* and thereby expands the pressure producing chamber 4. As a result, the ink flows into the pressure producing chamber 4 from the common ink chamber 5 via an ink supply inlet 17.

When the piezoelectric vibration element 12 expands toward the pressure producing chamber 4 as shown by the arrow B in FIG. 5 (B) after the elapse of a predetermined time, the effective displacement region of the vibration plate 6 is deformed toward the pressure producing chamber through the island portion 6*c*. As a result, the pressure producing chamber 4 is contracted, which in turn causes an ink droplet to be jetted out of the nozzle opening 2.

Since the central point C1 of the piezoelectric vibration element 12 is positioned so as to be displaced toward the nozzle opening 2 by $\Delta d$ from the central point C2 of the effective displacement region of the vibration plate 6, the quantity of deformation of the vibration plate 6 on the nozzle opening side becomes greater than the quantity of elastic deformation $\Delta\Theta$ of the ink supply inlet 17 in the process of compression. This fact means that the region close to the nozzle opening 2 is further reliably compressed even during the ink jetting operation in which the piezoelectric vibration element 12 expands at high speed compared with the ink sucking process. As a result, the ink droplet is pushed out efficiently.

(Embodiment)

The following results were obtained from measurements of the quantity of ink jarred. The measurement was made with an ink jet recording head prepared by forming a pressure producing chamber 4, the length L of the effective displacement region thereof being 1.0 mm and the width W and depth H thereof being 0.1 mm, The chamber 4 was sealed by a 0.002 mm thick vibration plate 6 that has an island portion 6*c* whose width w is 0.02 mm and whose thickness h is 0.03 mm formed therein. The ink jet recording head is further characterized as having a piezoelectric vibration element 12 of the vertical vibration mode with a displacement ranging from 0.0005 to 0.001 mm abutted against the vibration plate 6 such that a position of abutment of the piezoelectric vibration element 12 is shifted to a distance from the central point C2 of the effective displacement region. The quantity of ink jetted was measured using such ink jet recording head.

TABLE 1

| Displacement (mm) Δd | Ratio of displacement Δd to length L of effective displacement region of vibration plate Δd/L | Quantity of ink jetted (μg) |
|---|---|---|
| 0 | 0 | 0.169 |
| 0.05 | 0.05 | 0.171 |
| 0.10 | 0.10 | 0.188 |

It was verified from these measurements that in order to increase the quantity of ink jetted it is effective to cause the piezoelectric vibration element 12 to be abutted against the vibration plate 6 by displacing the piezoelectric vibration element 12 toward the nozzle opening from the central portion C2 of the effective displacement region of the vibration plate 6.

While the case where a recording head of such type that the effective displacement region of the vibration plate 6 is defined by the faces *7a*, *7b* of the frame 7 has been exemplified in the aforementioned embodiment, the invention may similarly be applied to those recording heads of such type that the effective displacement region of the vibration plate is defined by other modes.

Figure 6:
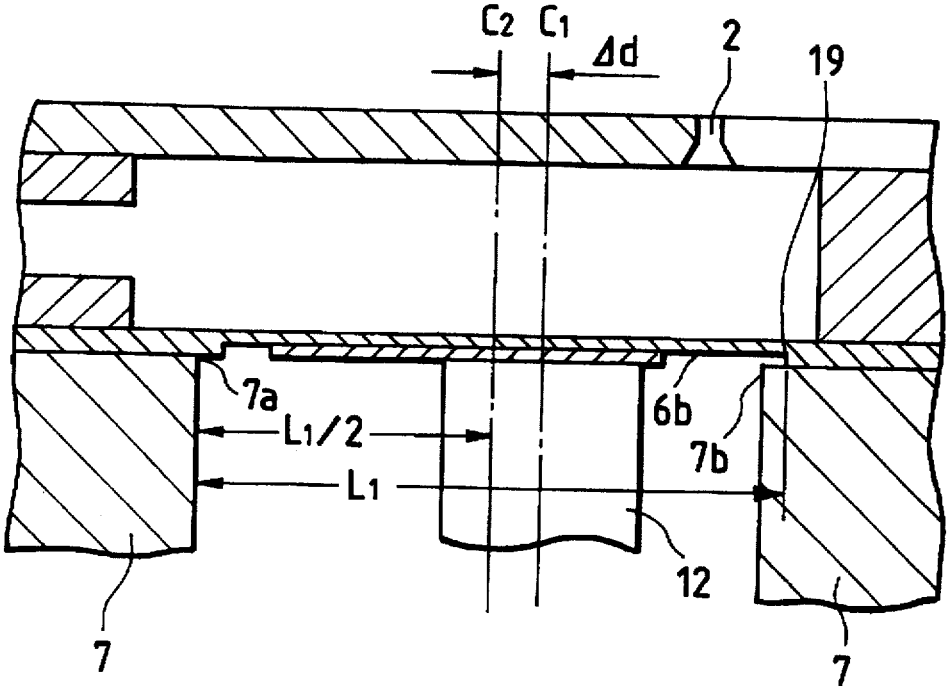
FIG. 6 is an enlarged view showing the surface of abutment between a piezoelectric vibration element and the vibration plate in another embodiment of the invention.
Figure 7:
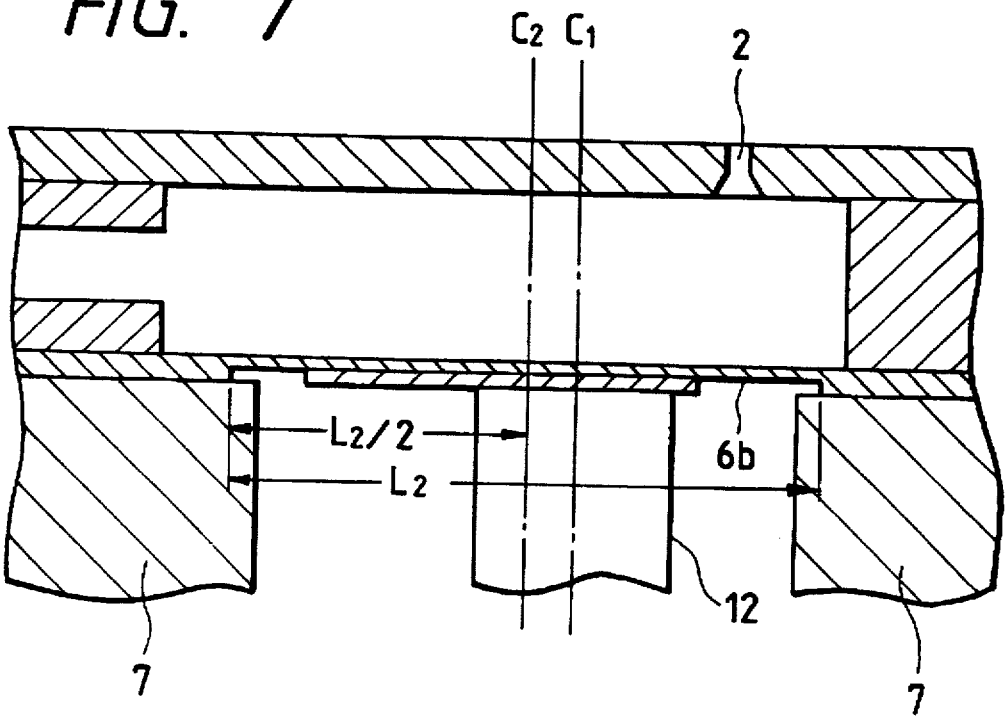
FIG. 7 is an enlarged view showing the surface of abutment between a piezoelectric vibration element and the vibration plate in still another embodiment of the invention.
Figure 8:
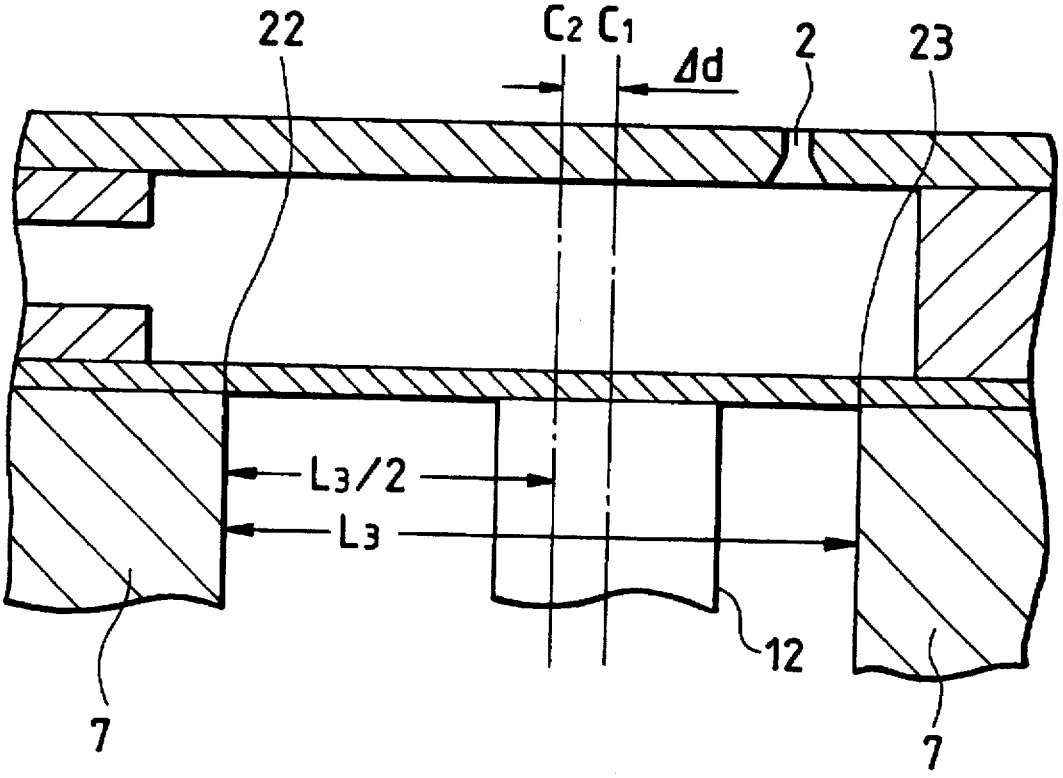
FIG. 8 is an enlarged view showing the surface of abutment between a piezoelectric vibration element and the vibration plate in still another embodiment of the invention.

As shown in FIG. 6, in a vibration plate 6 in which the end of the thin wall portion **6*b* of the vibration plate 6 projects from the face 7*b* so as to overhang the frame 7, the effective displacement region is equal to a distance L1 between the point 19 at which the vibration plate 6 is bonded to the frame 7 and the other face 7*a*. Further, as shown in FIG. 7, in a vibration plate 6 in which both ends of the thin wall portion 6*b* of the vibration plate 6 overhang the frame 7, the effective displacement region is equal to a distance L2 between the two points 20, 21 at which the vibration plate 6 is fixed to the frame surface. Still further, as shown in FIG. 8, in a vibration plate 6 in which the island portion overhangs the frame 7, the effective displacement region is equal to a distance L3 between the points 22, 23 at which the vibration plate 6 is bonded to the frame. Thus, the piezoelectric vibration element 12 can be arranged by displacing the central point C1 of the piezoelectric vibration element 12 toward the nozzle opening 2** from the central point C2 of the effective displacement region, i.e., the position defined by L1/2, L2/2, or L3/2, in other words half the distance L1, L2, or L3.

According to the embodiments particularly shown in FIGS. 6 and 7, the ink jetting efficiency of a recording head can be improved with ease merely modifying the pattern of the thin wall portion of the vibration plate 6, which is easier to redesign than the frame.

As described in the foregoing, the invention is characterized as causing the piezoelectric vibration element to be abutted against the vibration plate such that the central point C1 of the piezoelectric vibration element is displaced toward its corresponding nozzle opening by a distance Δd from the central point of the effective displacement region of the vibration plate. Therefore, the displacement of the piezoelectric vibration element for contracting the pressure producing chamber can be transmitted effectively to a region close to the corresponding nozzle opening. In a flow path unit, in particular, in which the fluid impedance of the ink supply inlet is set to a low value, the ink in the pressure producing chamber can be compressed effectively independently of the mode of elastic deformation of the island portion, thus allowing a large quantity of ink to be jetted under high speed driving.

What is claimed is:

1. An ink jet recording head comprising:

a flow path unit including a spacer, a nozzle plate, and a vibration plate, said spacer defining a pressure producing chamber, an ink supply inlet, and a common ink chamber, said nozzle plate sealing a single surface of said spacer and having a nozzle opening communicating with an end of the pressure producing chamber, and said vibration plate sealing another surface of said spacer and expanding and contracting the pressure producing chamber during operation of the ink jet recording head through movement of an effective displacement region of said vibration plate;

a piezoelectric vibration element of longitudinal vibration mode, a tip of said piezoelectric vibration element being abutted against said vibration plate for displacing said vibration plate during the operation, wherein said piezoelectric vibration element abuts against said vibration plate such that a center of the tip of said piezoelectric vibration element is displaced toward the nozzle opening by a predetermined distance Δd from a central point of the effective displacement region of said vibration plate.

2. An ink recording head according to claim 1, wherein a ratio of a length L of the effective displacement region to the displacement distance Δd (Δd/L) ranges from 0.05 to 0.1.

3. An ink jet recording head according to claim 1, wherein a fluid impedance of the nozzle opening is set to a value larger than a fluid impedance of the ink supply inlet.

4. An ink jet recording head according to claim 1, wherein the effective displacement region is defined by boundaries at which said vibration plate is bonded to a frame supporting the vibration plate.

5. An ink jet recording head according to claim 1, wherein the effective displacement region is defined by an end portion of a thin wall portion of said vibration plate.

6. An ink recording head according to claim 1, wherein the displacement distance Δd is predetermined such that a ratio of a length L of the effective displacement region to the displacement distance, Δd/L is equal to at least 0.05.

* * * * *